United States Patent [19]

Kashiwagi et al.

[11] Patent Number: 4,686,338

[45] Date of Patent: Aug. 11, 1987

[54] CONTACT ELECTRODE MATERIAL FOR VACUUM INTERRUPTER AND METHOD OF MANUFACTURING THE SAME

[75] Inventors: Yoshiyuki Kashiwagi; Yasushi Noda; Kaoru Kitakizaki, all of Tokyo, Japan

[73] Assignee: Kabushiki Kaisha Meidensha, Japan

[21] Appl. No.: 698,865

[22] Filed: Feb. 6, 1985

[30] Foreign Application Priority Data

Feb. 25, 1984 [JP] Japan ..... 59-35025
Feb. 25, 1984 [JP] Japan ..... 59-35026

[51] Int. Cl.[4] ..... H01H 1/02; H01H 33/66; B22F 3/26; C22C 29/06

[52] U.S. Cl. ..... 200/264; 200/262; 200/265; 200/266; 200/144 B; 75/236; 75/240; 419/17; 419/27

[58] Field of Search ..... 428/553, 557, 558, 559, 428/569; 419/2, 27, 57, 58, 60, 15, 17, 23, 54, 55; 200/262, 264, 265, 266, 144 B; 75/236, 240; 29/875

[56] References Cited

U.S. PATENT DOCUMENTS

| | | | |
|---|---|---|---|
| 2,648,747 | 8/1953 | Graves | 200/166 |
| 3,125,441 | 3/1964 | Lafferty et al. | 75/65 |
| 3,683,138 | 8/1972 | Nabae et al. | 200/144 B |
| 3,818,163 | 6/1974 | Robinson | 200/144 B |
| 3,951,872 | 4/1976 | Neely | 252/513 |
| 4,032,301 | 6/1977 | Hassler et al. | 428/567 |
| 4,147,909 | 4/1979 | Hassler et al. | 200/265 |
| 4,554,425 | 11/1985 | Kashiwagi et al. | 200/265 |
| 4,584,445 | 4/1986 | Kashiwagi et al. | 200/265 |

FOREIGN PATENT DOCUMENTS

| | | |
|---|---|---|
| 083245 | 12/1982 | European Pat. Off. . |
| 0101024 | 2/1984 | European Pat. Off. . |
| 2346179 | 6/1975 | Fed. Rep. of Germany . |
| 2619459 | 3/1978 | Fed. Rep. of Germany . |
| 2024258 | 1/1980 | United Kingdom . |

OTHER PUBLICATIONS

Handbook of Powder Metallurgy, Hausner, 1973, pp. 12–13.

*Primary Examiner*—John F. Terapane
*Assistant Examiner*—Eric Jorgensen
*Attorney, Agent, or Firm*—Lane and Aitken

[57] ABSTRACT

A novel contact electrode material for vacuum interrupters is disclosed, by which the chopping current value inherent in contact material can be reduced so that it is possible to stably interrupt small lagging current due to inductive loads without generating surge voltages. The material is equivalent or superior to the conventional Cu-0.5Bi material in large current interrupting capability and dielectric strength. The material consists essentially of copper, chromium, iron or molybdenum and chromium carbide or molybdenum carbide. The metallographical microstructure is such that copper is infiltrated into a porous matrix formed by mutually bonding chromium powder, iron or molybdenum powder and metal carbide powder in diffusion state. In its manufacturing process, firstly copper is placed onto a powder mixture of chromium, iron or molybdenum, and chromium carbide or molybdenum carbide, and then the copper and the powder mixture is heated within a nonoxidizing atmosphere at a first temperature lower than the copper melting point and thereafter again at a second temperature higher than the copper melting point.

7 Claims, 31 Drawing Figures

$50Cu - 5Cr - 40Fe - 5Cr_3C_2$

50Cu – 20Cr – 20Fe – 10 $Cr_3C_2$

Secondary Electron Image 20μ

Characteristic X-ray Image 20μ

Characteristic X-ray Image 20μ

Characteristic X-ray Image 20μ

Characteristic X-ray Image 20μ

$50Cu - 40Cr - 5Fe - 5Cr_3C_2$

Secondary Electron Image 10 μ

Characteristic X-ray Image 10 μ

Characteristic X-ray Image 10 μ

Characteristic X-ray Image 10 μ

Characteristic X-ray Image 10 μ

50Cu — 10Cr — 35Mo — 5$Mo_2$C

Secondary Electron Image 10 μ

Characteristic X-ray Image 10 μ

Characteristic X-ray Image 10 μ

Characteristic X-ray Image 10 μ

Characteristic X-ray Image 10 μ

50Cu−20Cr−20Mo−5$Cr_3C_2$−5$Mo_2C$

Secondary Electron Image 10 μ

Characteristic X-ray Image 10 μ

Characteristic X-ray Image 10 μ

Characteristic X-ray Image 10 μ

Characteristic X-ray Image 10 μ

50Cu – 30Cr – 10Mo – 10$Cr_3C_2$

CONTACT ELECTRODE MATERIAL FOR VACUUM INTERRUPTER AND METHOD OF MANUFACTURING THE SAME

BACKGROUND OF THE INVENTION

1. Field of the Invention

The present invention relates generally to contact electrode material used for a vacuum interrupter and a method of manufacturing the contact electrode material, and more particularly to a contact electrode material for a vacuum interrupter which can reduce the chopping current value inherent in contact material so that a small lagging current due to inductive loads can stably be interrupted without generating surge voltages.

2. Description of the Prior Art

Contact electrode material exerts serious influences upon circuit interruption performance in a vacuum interrupter. Generally, the contact electrode is required to consistently satisfy the following various requirements:

(1) Higher large-current interrupting capability;
(2) Higher dielectric strength,
(3) Excellent anti-welding characteristic;
(4) Higher small lagging- or leading-current interrupting capability;
(5) Higher electric conductivity,
(6) Lower electrode contacting electric resistance; and
(7) Excellent anti-erosion characteristic.

In the above requirements, the item (4), in particular, will be explained in more detail hereinbelow. In the case where an inductive load is connected to a circuit to be interrupted, current lags as compared with voltage in phase. The current lagging as compared with voltage is called lagging current. On the other hand, in the case where a capacitive load is connected to a circuit to be interrupted, current leads as compared with voltage in phase. The current leading as compared with voltage is called leading current.

In order to improve the above-mentioned lagging- or leading-current interrupting capability, in particular the lagging-current interrupting capability, it is indispensable to reduce the chopping current value inherently determined in contact electrode material provided for a vacuum interrupter. The above chopping current value will be described in detail.

When a small AC current is interrupted by an interrupter, a small-current arc is produced between two contact electrodes. When the small AC arc current drops near zero, there exists an arc current chopping phenomenon such that the current wave begins to vibrate and then is chopped (suddenly drops to zero) before the current reaches zero. An arc current $I_o$ at which vibration begins is called unstable current; an arc current $I_c$ at which current is chopped is called chopping current. In practical use, since this chopping current generates surge voltage, there exists a danger that electrical devices connected to the circuit interrupter may be damaged.

The reason why the arc current is chopped is explained as follows: When arc current reaches near zero, since the number of metal particles emitted from the cathode spots decreases below a particle density at which arc can be maintained, the arc current becomes unstable, resulting in current vibration and further current chopping. Since the chopping current generates harmful surge voltages, it is preferable to reduce the chopping current as small as possible.

The chopping current value decreases with increasing vapor pressure of the cathode material (low melting point material), because the higher the vapor pressure, the longer metal vapor necessary for maintaining an arc will be supplied. Further, the chopping current value decreases with decreasing thermal conductivity of cathode material, because if thermal conductivity is high, heat on the cathode surface is easily transmitted into the cathode electrode and therefore the cathode surface temperature drops abruptly, thus reducing the amount of metal vapor omitted from the cathode spot.

Therefore, in order to reduce the chopping current value, it is preferable to make the contact electrode of a material having a low thermal conductivity and high vapor pressure (low melting point). In contrast with this, however, in order to improve the large-current interrupting capability, it is preferable to make the contact electrode of a material having a high thermal conductivity and low vapor pressure (high melting point). As described above, since the high current interrupting capability is contrary to the low chopping current value, various efforts have been made to find out special alloys suitable for the contact electrode for a vacuum interrupter.

Description has been made of the mutually inconsistent relationship between large-current interrupting capability and small-current interrupting capability. However, there exists the other mutually inconsistent relationship between the requirements already stated above with respect to the contact electrode material for a vacuum interrupter.

For instance, U.S. Pat. No. 3,246,976 discloses a copper alloy for contact electrode, which includes bismuth (Bi) of 0.5 percent by weight (referred to as Cu-0.5Bi hereinafter). Further, U.S. Pat. No. 3,596,027 discloses another copper alloy for contact electrode, which includes a small amount of a high vapor pressure material such as tellurium (Te) and selenium (Se) (referred to as Cu-Te-Se, hereinafter). The Cu-0.5Bi or the Cu-Te-Se, including a high vapor pressure material, is excellent in large-current interrupting capability, anti-welding characteristic and electric conductivity; however, there exists a drawback such that the dielectric strength is low, in particular the dielectric strength is extremely reduced after large current has been interrupted. In addition, since the chopping current value is as high as 10 amperes, surge voltages are easily generated while current is interrupted, thus it being impossible to stably interrupt small lagging current. That is to say, there exists a problem in that electrical devices connected to a vacuum interrupter may often be damaged by the surge voltages.

On the other hand, in order to settle the above-mentioned problems resulting from the above Cu-0.5Bi or Cu-Te-Se, U.S. Pat. No. 3,811,939 discloses an alloy for contact electrodes, which substantially consists of copper of 20 percent by weight and tungsten of 80 percent by weight (referred to as 20Cu-80W hereinafter). Similarly, British Application Published Patent No. 2,024,257A discloses a copper alloy for contact electrodes, which includes a low vapor pressure material such as tungsten (W) skeleton (high melting point material) for use in high voltage. The 20 Cu-80 W or the copper-tungsten-skeleton alloy is high in dielectric strength; however, there exists a drawback such that it is difficult to stably interrupt a large fault current produced by an accident.

SUMMARY OF THE PRESENT INVENTION

With these problems in mind, therefore, it is the primary object of the present invention to provide a contact electrode material used for a vacuum interrupter and a method of manufacturing the same by which chopping current value can be so reduced that small lagging current can stably be interrupted without generating surge voltages while satisfying other various requirements such as large current interrupting capability, dielectric strength, anti-welding characteristic, etc.

To achieve the above-mentioned object, the contact electrode material for a vacuum interrupter according to the present invention consists essentially of 20 to 80% copper, 5 to 45% iron and 0.5 to 20% chromium carbide each by weight, in which copper is infiltrated between and into a porous matrix obtained by mutually bonding chromium powder, iron powder and chromium carbide powder by sintering in diffusion state.

Further, the contact electrode material for a vacuum interrupter according to the present invention consists essentially of 20 to 80% copper, 5 to 70% chromium 5 to 70% molybdenum and either or both of 0.5 to 20% chromium carbide or/and molybdenum carbide each by weight, in which copper is infiltrated between and into a porous matrix obtained by mutually bonding chromium powder, molybdenum powder and either or both of chromium carbide powder or/and molybdenum carbide powder by sintering in diffusion state.

Furthermore, the process of manufacturing the contact electrode material for a vacuum interrupter according to the present invention comprises the following steps of: (a) preparing chromium powder, iron or molybdenum powder and metal carbide powder which is selected from the group consisting of chromium carbide powder, molybdenum carbide powder, and a mixture of chromium powder and molybdenum carbide power, each having powder particle diameters of a predetermined value or less, e.g., 250 μm (60 mesh; (b) uniformly mixing said chromium powder, said iron or molybdenum powder of said metal carbide powder to obtain a powder mixture; (c) heating said powder mixture within a first nonoxidizing atmosphere for a first predetermined time at a first temperature lower than the melting points of said chromium, iron or molybdenum and metal carbide to obtain a porous matrix in which said chromium powder, said iron or molybdenum powder and said metal carbide powder are bonded by sintering to each other in diffusion state; (d) placing copper onto said porous matrix; and (e) heating said porous matrix on which said copper is placed within a second nonoxidizing atmosphere for a second predetermined time at a second temperature higher than the melting point of copper but lower than the melting points of said chromium, said iron or molybdenum, said metal carbide and said porous matrix to infiltrate said copper into said porous matrix.

In the above manufacturing process, it is also possible to previously place copper onto the mixture of chromium powder, iron or molybdenum ppowder and metal carbide powder, before heating the powder mixture within a nonoxidizing atmosphere at a first temperature (lower than the copper melting point). In this embodiment, the powder mixture on which copper is placed is further heated to a second temperature (higher than the copper melting point) with the same nonoxidizing atmosphere.

BRIEF DESCRIPTION OF THE DRAWINGS

The features and advantages of the contact electrode material for a vacuum interrupter and the method of manufacturing the same according to the present invention over the prior-art contact electrode material will be more clearly appreciated from the following description taken in conjunction with the accompanying drawings in which:

FIG. 2(*a*) is a secondary electron image photograph showing an insular porous matrix obtained by uniformly and mutually diffusion bonding chromium powder, iron powder and chromium carbide powder in black and copper infiltrated into the insular porous matrix in gray;

FIG. 2(B) is a characteristic X-ray image photograph showing insular agglomerates indicative of the presence of chromium in gray;

FIG. 2(C) is a characteristic X-ray image photograph showing insular agglomerates indicative of the presence of iron in white;

FIG. 2(D) is a characteristic X-ray image photograph showing faint points indicative of the presence of carbon in white;

FIG. 2(E) is a characteristic X-ray image photograph showing distributed parts indicative of the presence of copper infiltrated into the insular porous matrix in white;

FIG. 3(A) is a secondary electron image photograph showing an insular porous matrix obtained by uniformly and mutually diffusion bonding chromium powder, iron powder, and chromium carbide powder in black, and copper infiltrated into the insular porous matrix in gray;

FIG. 3(B) is a characteristic X-ray image photograph showing insular agglomerates indicative of the presence of chromium in gray;

FIG. 3(C) is a characteristic X-ray image photograph showing insular agglomerates indicative of the presence of iron in white;

FIG. 3(D) is a characteristic X-ray image photograph showing faint points indicative of the presence of carbon in white;

FIG. 3(E) is a characteristic X-ray image photograph showing distributed parts indicative of the presence of copper infiltrated into the insular porous matrix in white;

FIG. 4(A) is a secondary electron image photograph showing an insular porous matrix obtained by uniformly and mutually diffusion bonding chromium powder, iron powder, and chromium carbide powder in black, and copper infiltrated into the insular porous matrix in gray;

FIG. 4(B) is a characteristic X-ray image photograph showing insular agglomerates indicative of the presence of chromium in white;

FIG. 4(C) is a characteristic X-ray image photograph showing insular agglomerates indicative of the presence of iron in gray;

FIG. 4(D) is a characteristic X-ray image photograph showing faint points indicative of the presence of carbon in white;

FIG. 4(E) is a characteristic X-ray image photograph showing distributed parts indicative of the presence of copper infiltrated into the insular porous matrix in white;

FIG. 5(A) is a secondary electron image photograph showing an insular porous matrix obtained by uniformly and mutually diffusion bonding chromium powder, molybdenum powder and molybdenum carbide powder in white, and copper infiltrated into the insular porous matrix in gray or black;

FIG. 5(B) is a characteristic X-ray image photograph showing insular agglomerates indicative of the presence of chromium in white or gray;

FIG. 5(C) is a characteristic X-ray image photograph showing insular agglomerates indicative of the presence of molybdenum in white;

FIG. 5(D) is a characteristic X-ray image photograph showing faint points indicative of the presence of carbon in white;

FIG. 5(E) is a characteristic X-ray image photograph showing distributed parts indicative of the presence of copper infiltrated into the insular porous matrix in white;

FIG. 6(A) is a secondary electron image photograph showing an insular porous matrix obtained by uniformly and mutually diffusion bonding chromium powder, molybdenum powder, chromium carbide powder, and molybdenum carbide powder in white; and copper infiltrated into the insular porous matrix in gray or black;

FIG. 6(B) is a characteristic X-ray image photograph showing insular agglomerates indicative of the presence of chromium in white;

FIG. 6(C) is a characteristic X-ray image photograph showing insular agglomerates indicative of the presence of molybdenum in white;

FIG. 6(D) is a characteristic X-ray image photograph showing faint points indicative of the presence of carbon in white;

FIG. 6(E) is a characteristic X-ray image photograph showing distributed parts indicative of the presence of copper infiltrated into the insular porous matrix in white;

FIG. 7(A) is a secondary electron image photograph showing an insular porous matrix obtained by uniformly and mutually diffusion bonding chromium powder, molybdenum powder and chromium carbide powder in white, and copper infiltrated into the insular porous matrix in black;

FIG. 7(B) is a characteristic X-ray image photograph showing insular agglomerates indicative of the presence of chromium in white;

FIG. 7(C) is a characteristic X-ray image photograph showing insular agglomerates indicative of the presence of molybdenum in white;

FIG. 7(D) is a characteristic X-ray image photograph showing faint points indicative of the presence of carbon in white; and FIG. 7(E) is a characteristic X-ray image photograph showing distributed parts indicative of the presence of copper infiltrated into the insular porous matrix in white.

DETAILED DESCRIPTION OF THE PREFERRED EMBODIMENTS

With reference to the attached drawings, reference is now made to the embodiment of the contact electrode material according to the present invention. Prior to the description of the contact electrode material, the structure of a vacuum interrupter to which the contact electrodes made of the material according to the present invention is applied will be explained briefly hereinbelow with reference to FIG. 1.

Figure 1:
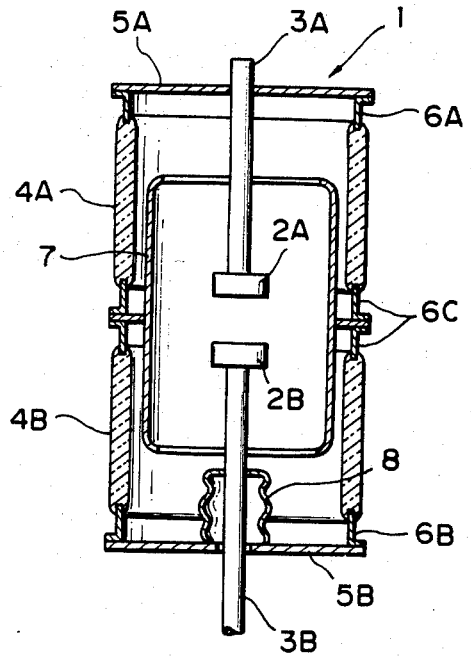
FIG. 1 is a longitudinal sectional view of a vacuum interrupter to which the contact electrode material according to the present invention is applied.

In FIG. 1, a vacuum interrupter is roughly made up of a vacuum vessel 1 and a pair of contact electrodes 2A and 2B joined to a pair of stationary and movable contact electrode rods 3A and 3B, respectively. The vacuum vessel 1 is evacuated to a vacuum pressure of 6.67 mPa ($5\times10^{-5}$ Torr) or less, for instance. The vacuum vessel 1 includes a pair of same-shaped insulating cylinders 4A and 4B made of glass or alumina ceramics, a pair of metallic end disc plates 5A and 5B made of stainless steel, and four thin metallic sealing rings 6A, 6B and 6C made of Fe-Ni-Co alloy or Fe-Ni alloy. The two insulating cylinders 4A and 4B are serially and hermetically connected by welding or brazing to each other with two sealing metallic rings 6c sandwiched therebetween at the inner adjacent ends of the insulating cylinders 4A and 4B. The two metallic end disc plates 5A and 5B are also hermetically connected by welding or brazing to the insulating cylinders 4A and 4B with the other two sealing metallic rings 6A and 6B sandwiched therebetween at the outer open ends of the insulating cylinders 4A and 4B. A cylindrical metallic arc shield made of stainless steel 7 which surrounds the contact electrodes 2A and 2B is hermetically supported by welding or brazing by the two sealing metallic rings 6c with the shield 7 sandwiched therebetween. Further, a thin metallic bellows 8 is hermetically and movably joined by welding or brazing to the movable contact electrode rod 3B and the end disc plate 5B on the lower side of the vacuum vessel 1. The arc shield 7 and the bellow shield 8 are both made of stainless steel.

One contact electrode 2A (upper) is secured by brazing to the stationary electrode rod 3A; the other contact electrode 2B (lower) is secured by brazing to the movable electrode rod 3B. The stationary electrode rod 3A is hermetically supported by the upper end disc plate 5A; the movable electrode rod 3B is hermetically supported by the bellows 8. The movable contact electrode 2B is brought into contact with or separated from the stationary contact electrode 2A.

The first embodiment of contact electrode material according to the present invention will be described hereinbelow. The material is a composite metal consisting essentially of copper of 20 to 80 percent by weight, chromium of 5 to 45 percent by weight, iron of 5 to 45 percent by weight and chromium carbide of 0.5 to 20 percent by weight. This composite metal has an electric conductivity of 5 to 30 percent in IACS (an abbreviation of International Annealed Copper Standard).

The metallographical feature of the composite metal according to the present invention is such that: copper (Cu) is infiltrated into an insular porous matrix obtained by uniformly and mutally bonding powder particles of chromium (Cr), iron (Fe) and chromium carbide ($Cr_3C_2$) by sintering in diffusion state. The above diffusion bonding means here that powder particles are not bonded to each other on the surfaces thereof but bonded to each other in such a way that one particle diffusely enters into the other particle beyond the surfaces thereof.

Further, the particle diameter of each metal powder (Cr, Fe, $Cr_3C_2$) is 60 mesh (250 μm) or less, but preferably 100 mesh (149 μm) or less.

The process of manufacturing the above-mentioned contact electrode material according to the present invention will be described hereinbelow. The process thereof can roughly be classified into two steps: the mutual diffusion bonding step and the copper infiltrating step. In the mutual diffusion bonding step, chromium powder (Cr), iron powder (Fe) and chromium carbide ($Cr_3C_2$) powder are bonded to each other into a porous matrix in diffusion state. In the copper infiltrating step, melted copper (Cu) is infiltrated into the porous matrix. Here, it should be noted that the melting point of chromium is approx. 1890° C., that of iron is approx. 1539° C., that of carbon is approx. 3700° C. and that of copper is approx. 1083° C. (the lowest).

Further, the process thereof can be achieved by three different methods as described hereinbelow.

In the first method:

In this method, the metal powder diffusion bonding step and copper infiltrating step are processed within two different nonoxidizing atmospheres. In more detail, firstly, Cr powder, Fe powder, and $Cr_3C_2$ powder each having the same particle diameter are prepared. The selected particle diameter is 100 mesh (149 μm) or less. Secondly, predetermined amounts of three metal (Cr, Fe, $Cr_3C_2$) powders are mechanically and uniformly mixed. Thirdly, the resultant powder mixture is placed in a vessel made of material non-reactive to Cr, Fe, $Cr_3C_2$ or Cu (e.g. aluminum oxide or alumina). Fourthly, the powder mixture in the vessel is heated within a nonoxidizing atmosphere at a temperature (e.g. 600° to 1000° C.) lower than the melting point of each metal powder for a predetermined time (e.g. 5 to 60 min.) in order that the powders (Cr, Fe, $Cr_3C_2$) are uniformly diffusion bonded to each other into a porous matrix. The nonoxidizing atmosphere is, for instance, a vacuum of 6.67 mPa ($5\times10^{-5}$ Torr) or less, hydrogen gas, nitrogen gas, argon gas, etc. Fifthly, a copper (Cu) block is placed onto the formed porous matrix. Sixthly, the porous matrix onto which the Cu block is placed is heated again within another nonoxidizing atmosphere at a temperature (e.g. 1100° C.) higher than the melting point of copper but lower than the melting points of other metal powders and the porous matrix for a predetermined time (e.g. 5 to 20 min) in order that the copper (Cu) is uniformly infiltrated into the porous matrix of Cr, Fe and $Cr_3C_2$. As described above, in this method, the porous matrix is formed before being infiltrated by the copper. However, being different from the above process it is also possible to manufacture the contact electrode material according to the present invention in such a manner that firstly the porous matrix is formed within a gas atmosphere (e.g. hydrogen gas) and then copper is infiltrated thereinto by evacuating the hydrogen gas.

In the second method:

In this method, the diffusion bonding step and the copper infiltrating step are processed within the same nonoxidizing atmosphere. In more detail, firstly, Cr powder, Fe powder and $Cr_3C_2$ powder each having the same particle diameter are prepared. The selected particle diameter is 100 mesh (149 μm) or less. Secondly, predetermined amounts of three (Cr, Fe, $Cr_3C_2$) powders are mechanically and uniformly mixed. Thirdly, the resultant powder mixture is placed in a vessel made of material non-reactive to Cr, Fe, $Cr_3C_2$ or Cu (e.g. alumina). Fourthly, a copper block is placed onto the powder mixture. Fifthly, the powder mixture onto which the copper block is placed in the vessel is heated within a nonoxidizing atmosphere at a temperature (e.g. 600° to 1000° C.) lower than the melting point of copper for a predetermined time (e.g. 5 to 60 min) in order that the metal powders (Cr, Fe, $Cr_3C_2$) are uniformly diffusion-bonded to each other to form a porous matrix. Sixthly, the same powder mixture is heated within the same nonoxidizing atmosphere at a temperature (e.g. 1100° C.) higher than the melting point of copper but lower than the melting points of the other metal powders and the porous matrix for a predetermined time (e.g. 5 to 20 min) in order that the copper block is uniformly infiltrated into the formed porous matrix of Cr, Fe, and $Cr_3C_2$. As described above, in this method, the porous matrix is formed before copper is infiltrated within the same nonoxidizing atmosphere.

In the third method:

In this method, copper powder is mixed with other powders instead of a copper block. In more detail, firstly, Cr powder, Fe powder, $Cr_3C_2$ powder and Cu powder each having the same particle diameter are prepared. Secondly, predetermined amounts of the four (Cr, Fe, $Cr_3C_2$, Cu) powders are mechanically and uniformly mixed. Thirdly, the resultant powder mixture is press-formed into a predetermined contact electrode shape. Fourthly, the press-shaped contact material is heated within a nonoxidizing atmosphere at a temperature higher or lower than the melting point of copper but below the melting points of other metal powders. In this third method, it is also possible to place an additional copper block onto the press-shaped contact material. In this case, however, it is necessary to heat the press-shaped contact material onto which the copper block is placed to a temperature higher than the melting point of copper.

In the above three methods, the particle diameter is not necessarily limited to 100 mesh (149 μm) or less. It is possible to select the metal powder particle diameter of 60 mesh (250 μm) or less. However, in the case where the particle diameter exceeds 60 mesh (250 μm), the diffusion distance increases in the diffusion bonding step of the metal powder particles and therefore the heating temperature should be high or the heating time should be long, thus lowering the productivity. Here, when one metal is diffused from the surface of the other metal, the diffused metal is rich near the surface of the other metal but poor inside the other metal. Therefore, the diffusion distance indicates a distance from the metal surface to a position at which the concentration of diffused metal equals that of the other metal to be diffused.

On the other hand, in the case where the metal powder particle diameter is extremely small (e.g. 1 μm or less), it is rather difficult to uniformly mix each metal powder because the powder is not dispersed uniformly. In addition, since the small-diameter metal powder is easily oxidized, it is necessary to previously treat the metal powder chemically, thus necessitating a troublesome process and also reducing the productivity. Therefore, metal powders having the particle diameter of 60 mesh (250 μm) or less should be selected under consideration of various factors.

Further, it is preferable to heat the metal powder mixture within a vacuum (as nonoxidizing atmosphere). This is because it is possible to simultaneously degasify and evacuate the atmosphere when heating it. However, it is of course possible to heat the powder mixture within a nonoxidizing atmosphere other than a vacuum without bringing up practical problems with the contact electrode material for a vacuum interrupter.

Further, the heating temperature and the heating time required for the mutual diffusion bonding step of metal powders should be determined under consideration of various factors such as furnace conditions, shape and size of the porous matrix to be formed, productivity, etc., so that various performances required for contact electrodes can be satisfied. In the methods described above, heat treatment conditions in the mutual diffusion bonding step are typically 600° C. in temperature and 1 to 2 h (hours) in time, or 1000° C. in temperature and 10 to 60 min (minutes) in time, for instance.

The metallographical structure or the microstructure of the first embodiment of the composite metal contact electrode material according to the present invention will be described hereinbelow with reference to FIGS. 2 to 4, the microphotographs of which are obtained by means of an X-ray microanalyzer. The contact electrode material shown in FIGS. 2 to 4 are manufactured in accordance with the second method in such a way that the metal powder mixture is heated within a vacuum of 6.67 mPa ($5\times10^{-5}$ Torr) or less at 1000° C. for 60 min to form a porous matrix and further heated within the same vacuum at 1100° C. for 20 min to infiltrate copper into the porous matrix.

Each component composition (percent by weight) of three test samples corresponding to the first embodiment of the present invention shown in FIGS. 2 to 4 is as follows:

1st Sample (FIG. 2): 50Cu-5Cr-40Fe-5$Cr_3C_2$
2nd Sample (FIG. 3): 50Cu-20Cr-20Fe-10$Cr_3C_2$
3rd Sample (FIG. 4): 50Cu-40Cr-5Fe-5$Cr_3C_2$ FIGS. 2(A) to 2(E) show microphotographs of the first test sample. This sample has a composition consisting essentially of 50% copper, 5% chromium, 40% iron, and 5% chromium carbide $Cr_3C_2$ each by weight.

Figure 2A:
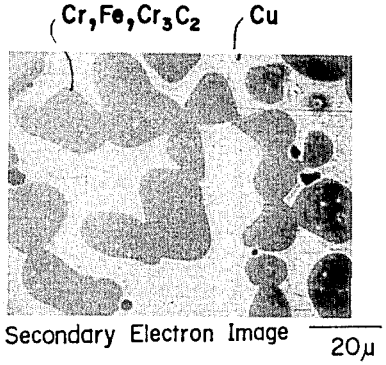
FIGS. 2(A) to 2(E) all are photographs taken by an X-ray microanalyzer, which show microstructures of a first test sample of a first embodiment of contact electrode material according to the present invention, the material thereof consisting essentially of 50 weight-percent copper, 5 weight-percent chromium, 40 weight-percent iron and 5 weight-percent chromium carbide.

FIG. 2(A) is a secondary electron image photograph taken by an X-ray microanalyzer, which clearly shows a microstructure of the first test sample of the first embodiment. In the photograph, the clear black insular agglomerates indicate the porous matrix obtained by mutually diffusion bonding Cr, Fe and $Cr_3C_2$ powders; the distributed gray or white parts indicate copper infiltrated into the insular porous matrix.

Figure 2B:
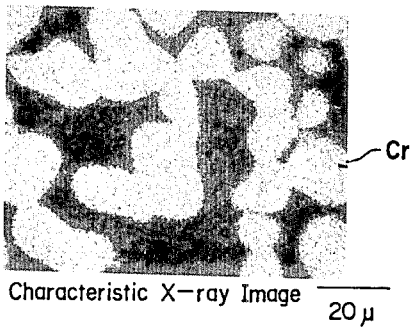
Figure 2C:
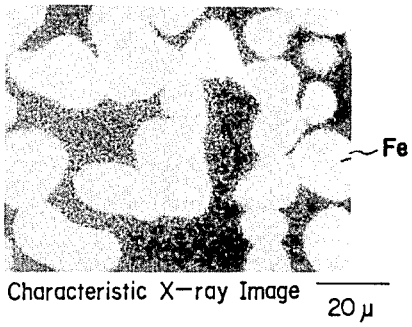
Figure 2D:
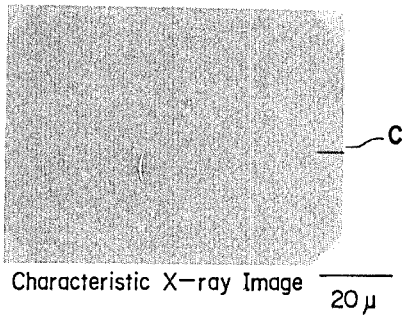
Figure 2E:
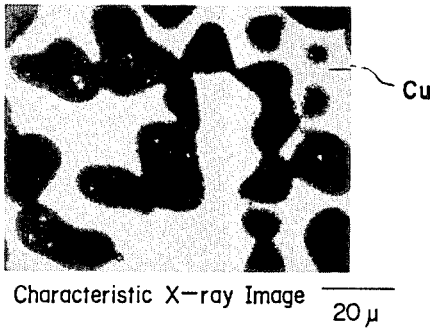

FIG. 2(B) shows a characteristic X-ray image of chromium (Cr), in which white or gray insular agglomerates indicate the presence of diffused chromium. FIG. 2(C) shows a characteristic X-ray image of iron (Fe), in which white insular agglomerates indicate the presence of diffused iron. FIG. 2(D) shows a characteristic X-ray image of carbon (C), in which faint white dots indicate the presence of a small amount of scattered carbon, FIG. 2(E) shows a characteristic X-ray image of copper (Cu), in which white distributed parts indicate the presence of copper infiltrated into the black insular porous matrix.

When comparing these photographs with each other, excluding FIG. 2(D), it is clear that the insular agglomerates are the same in shape. This indicates that the insular agglomerates include chromium and iron but not copper. Although the carbon is not clearly shown, it is quite clear that chromium carbide $Cr_3C_2$ is also distributed or diffused within the insular agglomerates. FIG. 2(B) clearly shows that chromium is uniformly diffused and black dots indicative of other metals (Fe, $Cr_3C_2$) are also uniformly diffused. Further, in FIG. 2(B), the white regions indicate that chromium is rich; the gray regions indicate that chromium is poor; the black regions indicate that no chromium is present.

Here, it should be noted in particular that the edges or boundaries of insular agglomerates are not clear excepting FIG. 2(A). This indicates that an extremely small amount of copper is diffused into porous matrix near the boundary thereof in FIGS. 2(B), (C) and (E). That is to say, copper is infiltrated not only into porous spaces of the porous matrix but also diffused into the inner region of the porous matrix near the surfaces thereof.

In summary, these photographs clearly indicate that (1) chromium, iron and chromium carbide are uniformly and mutually diffusion-bonded into the insular porous matrix and (2) copper is infiltrated between and into the porous matrix.

FIGS. 3(A) to 3(E) show microphotographs of the second test sample. This sample has a composition consisting essentially of 50% copper, 20% chromium, 20% iron and 10% chromium carbide $Cr_3C_2$ each by weight.

Figure 3A:
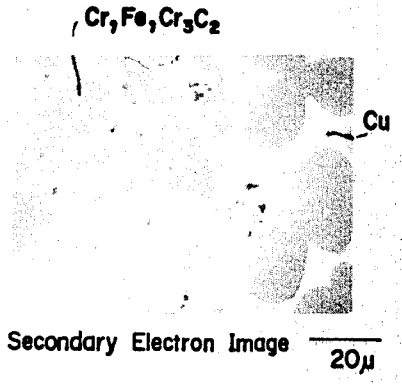
FIGS. 3(A) to 3(E) all are photographs taken by an X-ray microanalyzer, which show microstructures of a second test sample of the first embodiment of contact electrode material according to the present invention, the material thereof consisting essentially of 50 weight-percent copper, 20 weight-percent chromium, 20 weight-percent iron and 10 weight-percent chromium carbide.

FIG. 3(A) is a secondary electron image photograph similar to FIG. 2(A). FIGS. 3(B), 3(C), 3(D) and 3(E) are characteristic X-ray images of chromium, iron, carbon and copper, respectively, similar to FIGS. 2(B), 2(C), 2(D) and 2(E).

Figure 3B:
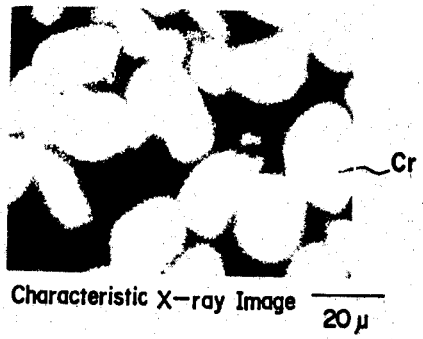
Figure 3C:
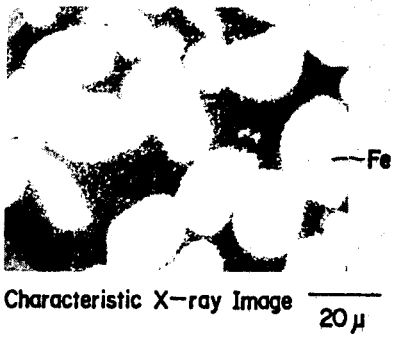
Figure 3D:
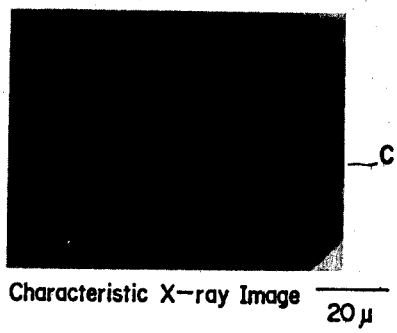
Figure 3E:
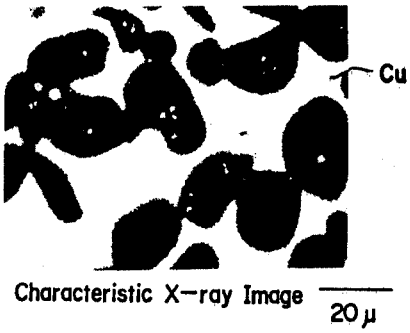

As compared with the first sample shown in FIGS. 2(A) to 2(E), since the second sample material includes a greater amount of chromium than in the first sample material, the insular agglomerates shown in FIG. 3(B) is whiter than that shown in FIG. 2(B). However, since the material includes a smaller amount of iron, the insular agglomerates shown in FIG. 3(C) is a little blacker than that shown in FIG. 2(C).

FIGS. 4(A) to 4(E) show microphotographs of the third test sample. This sample has a composition consisting essentially of 50% copper, 40% chromium, 5% iron, and 5% chromium carbide each by weight.

Figure 4A:
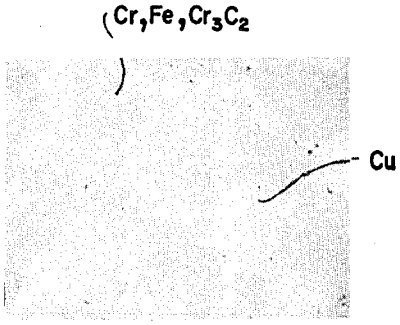
FIGS. 4(A) to 4(E) all are photographs taken by an X-ray microanalyzer, which show microstructures of a third test sample of the first embodiment of contact electrode material according to the present invention, the material thereof consisting essentially of 50 weight-percent copper, 40 weight-percent chromium, 5 weight-percent iron and 5 weight-percent chromium carbide.

FIG. 4(A) is a secondary electron image photograph similar to FIG. 2(A). FIGS. 4(B), 4(C), 4(D) and 4(E) are also characteristic X-ray images of chromium, iron, carbon and copper, respectively, similar to FIGS. 2(b), 2(C), 2(D), and 2(E).

Figure 4B:
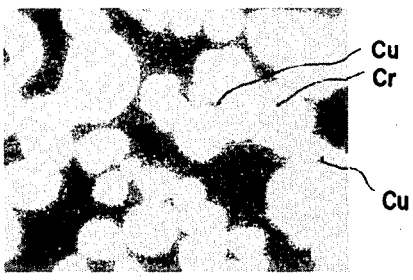

As compared with the second example shown in FIGS. 3(A) to 3(E), since the third test sample material includes a much greater amount of chromium, the insular agglomerates shown in FIG. 4(B) is whiter than that shown in FIG. 3(B). However, since the material includes a much smaller amount of iron, the insular agglomerates shown in FIG. 4(C) is much blacker than that shown in FIG. 3(C).

Further, in FIG. 4(B), some black spots (shown by Cu) located within a white insular agglomerate indicate positions at which copper is rich. This is because the smilar black spots can be seen at the corresponding positions in FIG. 4(C) (this indicates a metal (e.g. Cu) other than iron) and the similar white spots can be seen at the corresponding positions in FIG. 4(E) (this indicates copper).

Figure 4C:
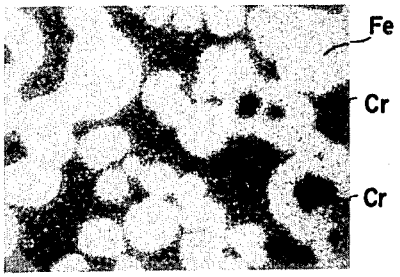
Figure 4D:
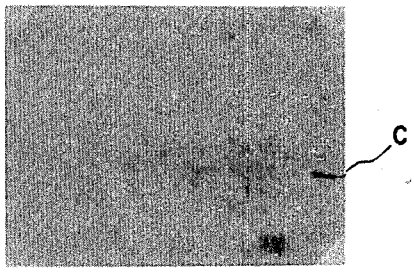
Figure 4E:
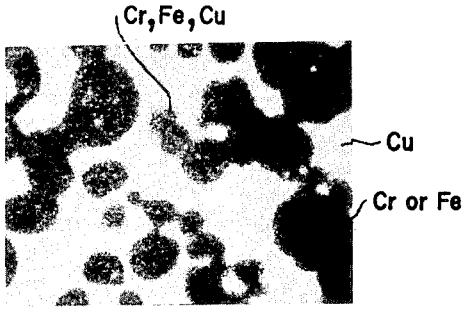

Further, in FIG. 4(C), some large black spots (shown by Cr) located within an insular agglomerate indicate positions at which chromium is rich. This is because the similar black spots cannot be seen in FIG. 4(B) (this indicates chromium) and the similar white spots cannot be seen in FIG. 4(E) (this indicates a metal (e.g. Cr) other than copper). Anyway, these black spots indicate that each metal powder is not perfectly uniformly diffused.

Various performances of the first embodiment of contact electrode material according to the present invention will be described hereinbelow. The test sample contact material is manufactured in accordance with the second method and machined to a disc-shaped test sample contact electrode. The test sample electrode is 50 mm in diameter and 6.5 mm in thickness having a chamfer radius of 4 mm at the edges thereof. Further, various tests have been performed by assembling the test sample electrodes in a vacuum interrupter as shown in FIG. 1. Three kinds of performance test samples are made of three sample materials already described as the first sample ($50Cu\text{-}5Cr\text{-}40Fe\text{-}5Cr_3C_2$), the second sample ($50Cu\text{-}20Cr\text{-}20Fe\text{-}10Cr_3C_2$) and the third sample ($50Cu\text{-}40Cr\text{-}5\text{-}Fe\text{-}5Cr_3C_2$), respectively.

(1) Large-current interrupting capability

In 1st, 2nd and 3rd test samples, it is possible to interrupt a large current of 12 kA (r.m.s.) under conditions that rated voltage is 12 kV, transient recovery voltage is 21 kV (JEC-181) (Japanese Electric Commission Standard); and interruption speed is 1.2 to 1.5 m/s. The above capability is equivalent to that of the conventional Cu-0.5Bi contact electrode material.

(2) Dielectric strength

In 1st, 2nd and 3rd test samples, the dielectric strength is ±110 kV (standard deviation ±10 kV) in impulse voltage withstand test with a 3.0 mm gap between stationary and movable contact electrodes.

Further, although the same test if performed after a large current (12 kA) has been interrupted several times, the same dielectric strength is obtained. Further, although the same test is performed after a small leading current of 80 A (r.m.s.) has been interrupted many times, the dielectric strength is the same.

In the case of the conventional Cu-0.5Bi contact electrode material, the same dielectric strength can be obtained when the gap between the electrodes is set to 10 mm. Therefore, in the contact material according to the present invention, it is possible to enhance dielectric strength as much as 3 times that of the conventional Cu-0.5Bi material.

(3) Anti-welding characteristic

In 1st, 2nd and 3rd test samples, it is possible to easily separate two electrodes by a static force of 1961N (200 kgf) after a current of 25 kA (r.m.s.) has been passed for 3 s (seconds) under a pressure force of 1275N (130 kgf) (IEC short time current standard) (International Electric Commission Standard). An increase in electrode contacting electric resistance after electrodes separation is less than 4 to 10 percent of the initial value. Further, it is also possible to easily separate two electrodes after a current of 50 kA (r.m.s.) has been passed for 3 s (seconds) under a pressure force of 9807N (1000 kgf). An increase in electrode contacting electric resistance after electrodes separation is less than 0 to 6 percent of the initial value.

When compared with the conventional Cu-0.5Bi contact material, the anti-welding characteristic of the samples according to the present invention is about 70% of that of the conventional one. However, the above characteristic is sufficient in practical use. Where necessary, it is possible to increase the instantaneous electrode separating force a little when the movable electrode is separated from the stationary electrode.

(4) Small lagging current (due to inductive load) interrupting capability

In the 1st test sample, the chopping current value is 1.1 A on an average (the standard deviation $\sigma_n$ is 0.2 A; the sampler number n is 100) when a small lagging current test ($84\times1.5/\sqrt{3}$ kV, 30 A) (JEC-181) is performed. In the 2nd test sample, the chopping current value is 1.4 A on an average ($\sigma_n\times0.2$ A; n=100). In the 3rd test sample, the chopping current value is 1.3 A on an average ($\sigma_n=0.2$ A; n=100). As compared with the conventional Cu-0.5Bi contact material, the chopping current value is as small as about 0.1 times that of the conventional one. Therefore, the chopping surge voltage is not significant in practical use. Further, the chopping current value does not change after the large current has been interrupted.

(5) Small leading current (due to capacitive load) interrupting capability

In the 1st, 2nd, 3rd test samples, no reignitions are generated when a small leading current test ($84\times1.25/\sqrt{3}$ kV, 80 A) (JEC-181) is being repeatedly performed 10000 times. As compared with the conventional Cu-0.5Bi contact material, it is possible to interrupt a circuit including capacitive loads 2 times greater than that interruptable by the conventional one.

(6) Electric conductivity

In the 1st, 2nd and 3rd test samples, the electric conductivity is 8 to 11 percent (IACS %). (International annealed copper standard).

(7) Hardness

In the 1st, 2nd, and 3rd test samples, the hardness is 112 to 194 Hv, 9.807N (1 kgf).

In the first embodiment described above, the composite metal consists essentially of 20 to 80% copper, 5 to 45% chromium, 5 to 45% iron and 0.5 to 20% chromium carbide each by weight. The above chromium carbide is $Cr_3C_2$. However, with respect to the chromium carbide, it is also possible to obtain the similar good results even when $Cr_7C_3$ or $Cr_{23}C_6$ is used in place of $Cr_3C_2$.

By the way, it is impossible to obtain satisfactory contact electrode performances in the case where the above mentioned weight percentages of the component composition in composite metal deviate out of the above predetermined ranges. In more detail, when the copper content is less than 20% by weight, the electric conductivity decreases abruptly; the electrode contacting electric resistance after short-time current test increases abruptly; Joule heat loss produced when a rated current is being passed increases, thus it being impossible to put the contact material into practical use. On the other hand, when the copper content is more than 80% by weight, the dielectric strength decreases and additionally the anti-welding characteristic deteriorates abruptly.

When the chromium content is less than 5% by weight, the chopping current value increases and therefore the small lagging current interrupting capability deteriorates. When the chromium content is more than 45% by weight, the large current interrupting capability deteriorates abruptly. When the iron content is less than 5% by weight, the chopping current value increases. When the iron content is more than 45% by weight, the large current interrupting capability deteriorates abruptly. Further, the chromium carbide content is less than 0.5% by weight, the chopping current value increases abruptly. When the chromium carbide content is more than 20% by weight, the large current interrupting capacility deteriorates abruptly.

The second embodiment of contact electrode material according to the present invention will be described hereinbelow. The material is a composite metal consisting essentially of copper of 20 to 80 percent by weight, chromium of 5 to 70 percent by weight, molybdenum of 5 to 70 percent by weight and either or both of chromium carbide or/and molybdenum carbide of 0.5 to 20 percent by weight (in the case where both are included, the total of both is 0.5 to 20 percent by weight). This composite metal has an electric conductivity of 20 to 60 percent in IACS.

The metallographical feature of the composite metal according to the present invention is such that: copper is infiltrated into an isular porous matrix obtained by uniformly and mutually bonding powder particles of chromium (Cr), molybdenum (Mo) and either or both of chromium carbide ($Cr_3C_2$) or/and molybdenum carbide ($Mo_2C$) by sintering in diffusion state.

Further, the particle diameter of each metal powder (Cr, Mo, $Cr_3C_2$ or/and $Mo_2C$) is 60 mesh (250 μm) or less, but preferably 100 mesh (149 μm) or less.

The process of manufacturing the above-mentioned contact electrode according to the present invention will be described hereinbelow. Similarly to the first embodiment, the process thereof can roughly be classified in two steps: the mutual diffusion bonding step and the copper infiltrating step. In the mutual diffusion bonding step, chromium powder (Cr), molybdenum powder (Mo) and either or both of chromium carbide ($Cr_3C$) or/and molybdenum carbide ($Mo_2C$) are bonded to each other into a porous matrix in diffusion state. In the infiltrating step, melted copper (Cu) is infiltrated into the porous matrix. Here, it should be noted that the melting point of chromium is approx. 1890° C., that of molybdenum is approx. 2625° C., that of carbon is approx. 3700° C. and that of copper is approx. 1083° C. (the lowest).

Further, the process thereof can be achieved by threee different methods as described hereinbelow.

In the first method:

In this method, the metal powder diffusion bonding step and copper infiltrating step are processed within two different nonoxidizing atmospheres. In more detail, firstly Cr powder, Mo powder, and either or both of $Cr_3C_2$ or/and $Mo_2C$ powder each having the same particle diameter are prepared. The selected particle diameter is 100 mesh (149 μm) or less. Secondly, predetermined amounts of three (Cr, Mo, $Cr_3C_2$or $Mo_2C$) or four (Cr, Mo, $Cr_3C_2$, $Mo_2C$) powders are mechanically and uniformly mixed. Thirdly, the resultant powder mixture is placed in a vessel made of material non-reactive to Cr, Mo, $Cr_3C_2$, $Mo_2C$ or Cu (e.g. aluminum oxide or alumina). Fourthly, the powder mixture in the vessel is heated within a nonoxidizing atmosphere at a temperature (e.g. 600° to 1000° C.) lower than the melting point of each powder for a predetermined time (e.g. 5 to 60 min) in order that the powders (Cr, Mo, $Cr_3C_2$ or/and $Mo_2C$) are uniformly diffusion bonded to each other into a porous matrix. The nonoxidizing atmosphere is, for instance, a vacuum of 6.67 mPa ($5\times10^{-5}$ Torr) or less, hydrogen gas, nitrogen gas, argon gas, etc. Fifthly, a copper (Cu) block is placed onto the porous matrix. Sixthly, the porous matrix onto which the Cu block is placed is heated within another nonoxidizing atmosphere at a temperature (e.g. 1100° C.) higher than the melting point of copper but lower than the melting points of other metal powders and the porous matrix for a predetermined time (e.g. 5 to 20 min) in order that the copper (Cu) is uniformly infiltrated into the porous matrix of Cr, Mo, $Cr_2C_2$ or/and $Mo_2C$.

In the second method:

In this method, the diffusion bonding step and the copper infiltrating step are processed within the same nonoxidizing atmosphere. In more detail, firstly Cr powder, Mo powder and $Cr_3C_2$ or/and $Mo_2C$ powder each having the same particle diameter are prepared. The selected particle diameter is 100 mesh (149 μm) or less. Secondly, predetermined amounts of three (Cr, Mo, $Cr_3C_2$ or $Mo_2C$) or four (Cr, Mo, $Cr_3C_2$, $Mo_2C$) powders are mechanically and uniformly mixed. Thirdly, the resultant powder mixture is placed in a vessel made of material non-reactive to Cr, Mo, $Cr_3C_2$, $Mo_2C$ or Cu (e.g. alumina). Fourthly, a copper block is placed onto the powder mixture. Fifthly, the powder mixture onto which the copper block is placed in the vessel is heated within a nonoxidizing atmosphere at a temperature (e.g. 600° to 1000° C.) lower than the melting point of copper for a predetermined time (e.g. 5 to 60 min) in order that powders (Cr, Mo, $Cr_3C_2$ or/and $Mo_2C$) are uniformly diffusion bonded to each other into a porous matrix. Sixthly, the same powder mixture is heated within the same nonoxidizing atmosphere at a temperature (e.g. 1100° C.) higher than the melting point of copper but lower than the melting points of other metal powders and the porous matrix for a predetermined time (e.g. 5 to 20 min) in order that the copper block is uniformly infiltrated into the porous matrix of Cr, Mo, $Cr_3C_2$ or/and $Mo_2C$.

In the third method:

In this method, copper powder is mixed with other powders instead of a copper block. In more detail, firstly, Cr powder, Mo powder, $Cr_3C_2$ or/and $Mo_2C$ powder and Cu powder each having the same particle diameter are prepared. Secondly, predetermined amounts of four (Cr, Mo, $Cr_3C_2$ or $Mo_2C$, Cu) or five (Cr, Mo, $Cr_3C_2$, $Mo_2C$, Cu) powders are mechanically and uniformly mixed. Thirdly, the resultant powder mixture is press-formed into a predetermined contact shape. Fourthly, the press-shaped contact material is heated within a nonoxidizing atmosphere at a temperature higher or lower than the melting point of copper but lower than the melting points of the other metal powders. In this third method, it is also possible to place an additional copper block onto the press-shaped contact material. In this case, however, it is necessary to heat the press-shaped contact material onto which the copper block is placed to a temperature higher than the melting point of copper.

In the above three methods, the particle diameter is not limited to 100 mesh (149 μm) or less. It is preferable to select the metal powder particle diameter of 60 mesh (250 μm) or less. Further, in the above methods, Cr powder and Mo powder are both prepared separately. However, it is also possible to previously make an alloy of Cr and Mo and then prepare this Cr-Mo alloy powder having particle diameter of 100 mesh (149 μm) or less.

The metallographical structure or the microstructure of the second embodiment of the composite metal contact electrode material according to the present invention will be described hereinbelow with reference to FIGS. 5 to 7, the microphotographs of which are obtained by means of an X-ray microanalyzer. The contact electrode material shown in FIGS. 5 to 7 are manufactured in accordance with the second method in such a way that the metal powder mixture is heated within a vacuum of 6.67 mPa ($5\times10^{-5}$ Torr) or less at 1000° C. for 60 min to form a porous matrix and further heated within the same vacuum at 1100° C. for 20 min to infiltrate copper into the porous matrix.

Each component composition (percent by weight) of three test samples corresponding to the second embodiment of the present invention shown in FIGS. 5 to 7 is as follows:

1st Sample (FIG. 5): 50Cu-10Cr-35Mo-5$Mo_2C$

2nd Sample (FIG. 6): 50Cu-20Cr-20Mo-5$Cr_3C_2$-5$Mo_2C$

3rd Sample (FIG. 7): 50Cu-30Cr-10Mo-10$Cr_3C_2$

FIGS. 5(a) to 5(E) show microphotographs of the first test sample. This sample has a composition consisting essentially of 50% copper, 10% chromium, 35% molybdenum, and 5% molybdenum carbide each by weight.

Figure 5A:
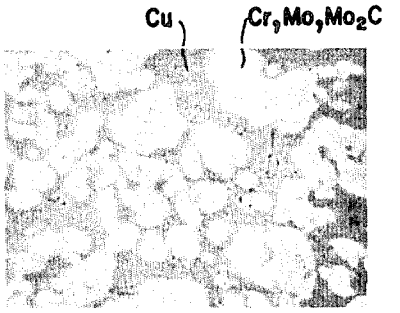
FIGS. 5(A) to 5(E) all are photographs taken by an X-ray microanalyzer, which show microstructures of a first test sample of a second embodiment of contact electrode material according to the present invention, the material thereof consisting essentially of 50 weight-percent copper, 10 weight-percent chromium, 35 weight-percent molybdenum, and 5 weight-percent molybdenum carbide.

FIG. 5(A) is a secondary electron image photograph taken by an X-ray microanalyzer, which clearly shows a microstructure of the first test sample of the second embodiment. In the photograph, the white insular agglomerates indicate the porous matrix obtained by mutually diffusion bonding Cr, Mo, and $Mo_2C$ powders; the distributed gray or black parts indicate copper infiltrated into the insular porous matrix.

Figure 5B:
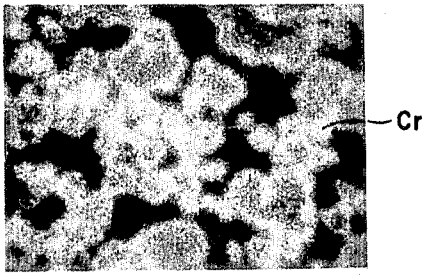
Figure 5C:
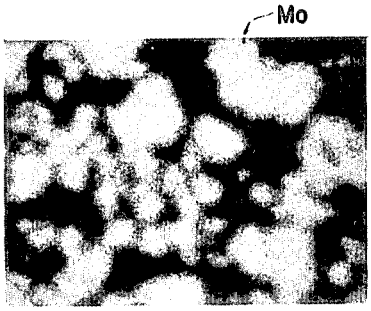
Figure 5D:
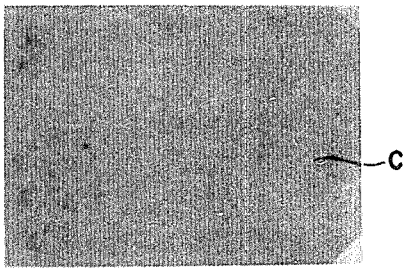
Figure 5E:
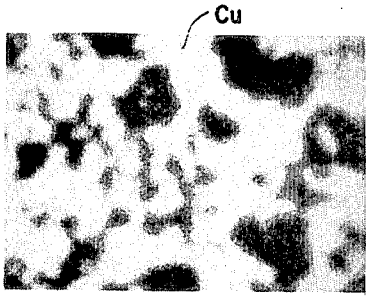

FIG. 5(B) shows a characteristic X-ray image of chromium (Cr), in which gray insular agglomerates indicate the presence of diffused chromium. FIG. 5(C) shows a characteristic X-ray image of molybdenum (Mo), in which gray insular agglomerates indicate the presence of diffused molybdenum. FIG. 5(D) shows a characteristic X-ray image of carbon (C), in which faint white dots indicate the presence of a small amounts of scattered carbon. FIG. 5(E) shows a characteristic X-ray image of copper (C), in which white distributed parts indicate the presence of copper infiltrated into the black insular porous matrix.

These photographs indicate that (1) chromium, molybdenum and molybdenum carbide are uniformly and mutually diffusion bonded into porous insular matrix and (2) copper is infiltrated into the porous matrix.

FIGS. 6(A) to 6(E) show microphotographs of the second test sample. This sample has a composition consisting essentially of 50% copper, 20% chromium, 20% molybdenum, 5% chromium carbide and 5% molybdenum carbide each by weight.

Figure 6A:
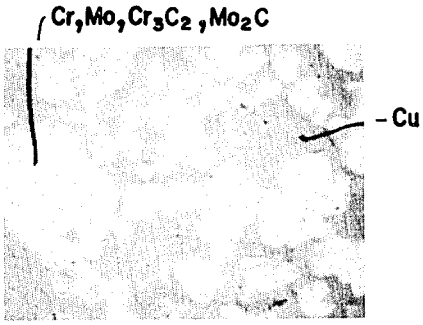
FIGS. 6(A) to 6(E) all are photographs taken by an X-ray microanalyzer, which show microstructures of a second test sample of the second embodiment of contact electrode material according to the present invention, the material thereof consisting essentially of 50 weight-percent copper, 20 weight-percent chromium, 20 weight-percent molybdenum, 5 weight-percent chromium carbide and 5 weight-percent molybdenum carbide.

FIG. 6(A) is a secondary electron image photograph similar to FIG. 5(A). FIGS. 6(B), 6(C), 6(D) and 6(E) are characteristic X-ray images of chromium, molybdenum, carbon, and copper, respectively, similar to FIGS. 5(B), 5(C), (D) and 5(E).

Figure 6B:
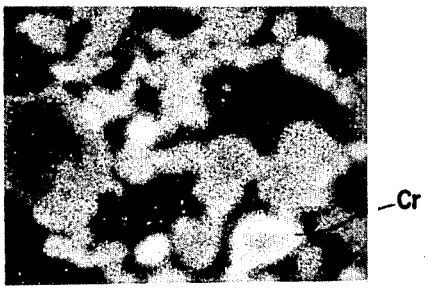
Figure 6C:
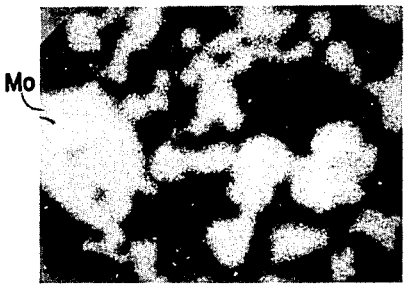
Figure 6D:
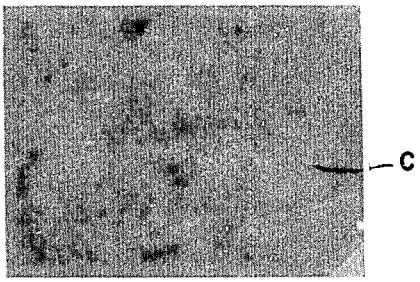
Figure 6E:
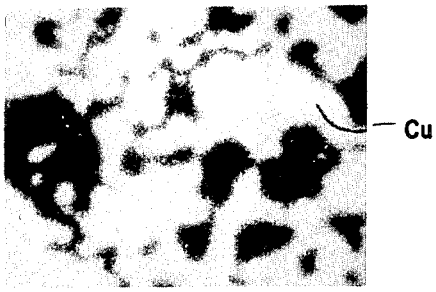

As compared with the first sample shown in FIGS. 5(A) to 5(E), since the second sample material includes a greater amount of chromium than in the first sample material, the insular agglomerates shown in FIG. 6(B) is a little whiter than that shown in FIG. 5(B). However, the difference between the first and second samples in molybdenum percent is not clearly shown.

FIGS. 7(A) to 7(E) show microphotographs of the third test sample. This sample has a composition consisting essentially of 50% copper, 30% chromium, 10% molybdenum, and 10% chromium carbide each by weight.

Figure 7A:
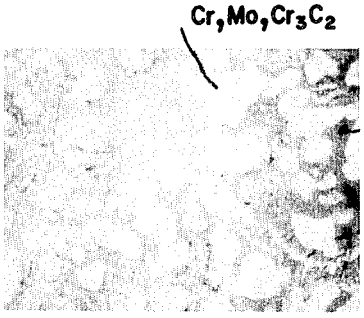
FIGS. 7(A) to 7(E) all are photographs taken by an X-ray microanalyzer, which show microstructures of a third test sample of the second embodiment of contact electrode material according to the present invention, the material thereof consisting essentially of 50 weight-percent copper, 30 weight-percent chromium, 10 weight-percent molybdenum, and 10 weight-percent chromium carbide.

FIG. 7(A) is a secondary electron image photograph similar to FIG. 5(A). FIGS. 7(B), 7(C), 7(D) and 7(E) are characteristic X-ray images of chromium, molybdenum, carbon and copper, respectively, similar to FIGS. 5(B), 5(C), 5(D) and 5(E).

Figure 7B:
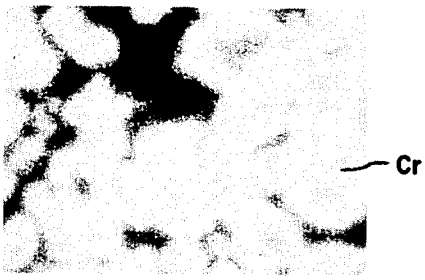
Figure 7C:
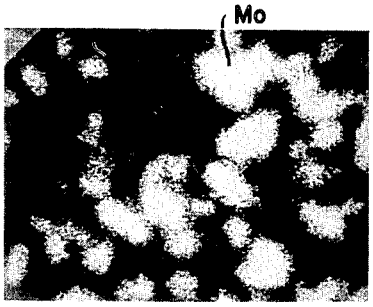
Figure 7D:
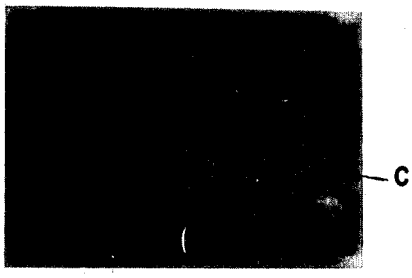
Figure 7E:
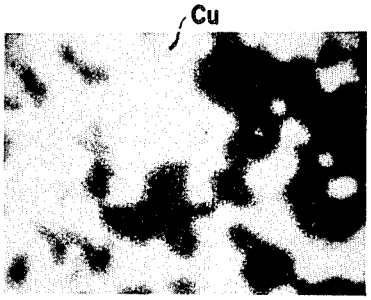

As compared with the second sample shown in FIGS. 6(A) to 6(E), since the third test sample includes a much greater amount of chromium, the insular agglomerates shown in FIG. 7(B) are much whiter than those shown in FIG. 6(B). However, the difference between the first, second and third samples in molybdenum percent is not clearly shown.

Various performances of the second embodiment of the contact electrode material according to the present invention will be described hereinbelow. The test sample contact material is manufactured and machined to a disc-shaped contact electrode similar to that of the first embodiment. That is, the diameter is 50 mm; the thickness is 6.5 mm; the chamfer radii are 4 mm. Further, various tests have been performed by assembling the test sample electrodes in the vacuum interrupter as shown in FIG. 1. Three kinds of performance test samples are made of three sample materials already described as the first sample (50Cu-10Cr-35Mo-5$Mo_2C$), the second sample (50Cu-20Cr-20Mo-5$Cr_3C_2$-5$Mo_2C$)

and the third sample (50Cu-30Cr-10Mo-10$Cr_3C_2$), respectively.

(1) Large-current interrupting capability

In 1st, 2nd, and 3rd test samples, it is possible to interrupt a large current of 12 kA (r.m.s.) under conditions that rated voltage is 12 kV; transient recovery voltage is 21 kV (JEC-181); and interruption speed is 1.2 to 1.5 m/s. The above capability is equivalent to that of the conventional Cu-0.5Bi contact electrode material.

(2) Dielectric strength

In the 1st test sample, the dielectric strength is ±120 kV (standard deviation ±10 kV) in impulse voltage withstand test with a 3.0 mm gap between stationary and movable contact electrodes.

Further, although the same test is performed after a large current (12 kA) has been interrupted several times, the same dielectric strength is obtained. Further, although the same test is performed after a small leading current (80 A) has been interrupted many times, the dielectric strength is the same.

On the other hand, in the 2nd and 3rd samples, the dielectric strength is +110 kV and −120 kV (each standard deviation ±10 kV).

In the case of the conventional Cu-0.5Bi contact electrode material, the same dielectric strength can be obtained when the gap between the electrodes is set to 10 mm. Therefore, in the contact material according to the present invention, it is possible to enhance the dielectric strength as much as 3 times that of the conventional Cu-0.5Bi material (3) Anti-welding characteristic In the 1st, 2nd, and 3rd test samples, it is possible to easily separate two electrodes by a static force of 1961N (200 kgf) after a current of 25 kA (r.m.s.) has been passed for 3s (seconds) under a pressure force of 1275N (130 kgf) (IEC short time current standard). An increase in contacting electric resistance after electrodes separation is less than 2 to 8 percent of the initial value. Further, it is possible to easily separate two electrodes after a current of 50 kA (r.m.s.) has been passed for 3s (seconds) under a pressure force of 9807N (1000 kgf). An increase in contacting electric resistance after electrodes separation is less than 0 to 5 percent of the initial value.

When compared with the conventional Cu-0.5Bi contact material, the anti-welding characteristic of the samples according to the present invention is about 80% of that of the conventional one. However, the above characteristic is sufficient in practical use. Where necessary, it is possible to increase the instantaneous electrodes separating force a little when the movable electrode is separated from the stationary electrode.

(4) Small lagging current (due to inductive load) interrupting capability

In the 1st test sample, the chopping current value is 1.3 A on an average (the standard deviation $\sigma_n$ is 0.2 A; the sample number n is 100) when a small lagging current test ($84\times1.5/\sqrt{3}$ kV, 30 A) (JEC-181) is performed. In the 2nd test sample, the chopping current value is 1.1 A on an average ($\sigma_n$=0.15 A; n=100). In the 3rd test sample, the chopping current value is 1.2 A on an average ($\sigma_n$=0.18 A; n=100).

As compared with the conventional Cu-0.5Bi contact electrode, the chopping current value is as small as about 0.13 times that of the conventional one. Therefore, the chopping surge voltage is not significant in practical use. Further, the chopping current value does not change after the large current has been interrupted.

(5) Small leading current (due to capacitive load) interrupting capability

In the 1st, 2nd, and 3rd test samples, no reignitions are generated when a small leading current test ($84\times1.25/\sqrt{3}$ kV, 80 A) (JEC-181) is being performed 10000 times. As compared wih the conventional Cu-0.5Bi contact material, it is possible to interrupt a circuit including capacitive loads 2 times greater than that interruptable by the conventional one.

(6) Electric conductivity

In the 1st test sample, the electric conductivity is 36 to 43 percent (IACS %). In the 2nd sample, it is 28 to 34 percent. In the 3rd sample, it is 25 to 30 percent.

(7) Hardness

In the 1st, 2nd, and 3rd test samples, the hardness is 106 to 182 Hv, 9.807N (1 kgf).

In the second embodiment described above, the composite metal consists essentially of 20 to 80% copper, 5 to 70% chromium, 5 to 70% molybdenum and either or both of 0.5 to 20% chromium carbide or/and molybdenum carbide each by weight. The above chromium carbide is $Cr_3C_2$ and the above molybdenum carbide is $Mo_2C$. However, with respect to the metal carbide, it is possible to obtain the similar good results even when $Cr_7C_3$ or $Cr_{23}C_6$ is used in place of $Cr_3C_2$ and MoC is used in place of $Mo_2C$.

By the way, it is impossible to obtain satisfactory contact electrode performances in the case where the above-mentioned weight percentages of the component composition in composite metal deviate out of the predetermined ranges. In more detail, when the copper content is less than 20% by weight, the electric conductivity decreases abruptly; the electrode contacting electric resistance after short-time current test increases abruptly; Joule heat loss produced when a rated current is being passed increases, thus it being impossible to put the contact material into practical use. On the other hand, when the copper content is more than 80% by weight, the dielectric strength decreases and additionally, the anti-welding characteristic deteriorates abruptly.

When the chromium content is less than 5% by weight, the chopping current value increases and therefore the small lagging interrupting capability deteriorates. When the chromium content is more than 70% by weight, the large current interrupting capability deteriorates abruptly. When the molybdenum content is less than 5% by weight, the dielectric strength decreases abruptly. When the molybdenum content is more than 70% by weight, the large current interrupting capability deteriorates abruptly.

Further, when either or both of the chromium carbide content or/and the molybdenum carbide content are less than 0.5% by weight, the chopping current value increases. When either or both of the contents are more than 20% by weight, the large current interrupting capability deteriorates abruptly.

As described above, in the contact electrode material according to the present invention, since the material is a composite metal consisting essentially of copper, chromium, iron and chromium carbide or a composite metal consisting essentially of copper, chromium, molybdenum and either or both of chromium carbide or/and molybdenum carbide, which is formed in such a way that copper is infiltrated into porous matrix obtained by uniformly and mutually bonding metal powders (Cr, Fe, $Cr_3C_2$) or (Cr, Mo. $Cr_3C_2$ and/or $Mo_2C$) other than copper by sintering in diffusion bonding, the contact material according to the present invention is equivalent to the conventional Cu-0.5Bi contact material in large current interrupting capability, but superior to the conventional one in dielectric strength. Particularly, since the chopping current value is reduced markedly in the contact electrode material according to the present invention, it is possible to stably interrupt small lagging current due to inductive loads without generating surge voltages; that is, without damaging electrical devices connected to the vacuum interrupter.

Further, in the method of manufacturing the contact electrode material according to the present invention, since the metal powders are uniformly bonded to each other in diffusion state into porous matrix and further copper is uniformly infiltrated into the porous matrix, it is possible to improve the mechanical characteristics as well as the above-mentioned electric characteristics and performances.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A contact electrode material for a vacuum interrupter, which consists essentially of
   (a) copper of 20 to 80 percent by weight;
   (b) chromium of 5 to 45 percent by weight;
   (c) iron of 5 to 45 percent by weight;
   (d) chromium carbide of 0.5 to 20 percent by weight; and
   (e) said copper being infiltrated into a porous matrix composed of insular agglomerates in which powders of said chromium, said iron and said chromium carbide with particle diameters of 250 μm (60 mesh) or less are mutually bonded to each other, said chromium, iron and chromium carbide being respectively diffused into particles of said other powders beyond the bonding surface thereof so that the local concentration of said chromium is variable between rich and poor.

2. The contact electrode material as set forth in claim 1, wherein said chromium carbide is selected from the group consisting of $Cr_3C_2$, $Cr_7C_3$, $Cr_{23}C_6$ and mixtures of at least two of $Cr_3C_2$, $Cr_7C_3$ and $cr_{23}C_6$.

3. The contact electrode material as set forth in claim 1, wherein particle diameters of said chromium powder, said iron powder and said chromium carbide powder are 149 μm (100 mesh) or less.

4. A contact electrode material for a vacuum interrupter, which consists essentially of:
   (a) copper of 20 to 80 percent by weight;
   (b) chromium of 5 to 70 percent by weight;
   (c) molybdenum of 5 to 70 percent by weight;
   (d) metal carbide of 0.5 to 20 percent by weight, said metal carbide being selected from the group consisting of chromium carbide, molybdenum carbide and mixtures of chromium carbide and molybdenum carbide; and
   (e) said copper being infiltrated into a porous matrix composed of insular agglomerates in which powders of said chromium, said molybdenum, and said metal carbide with particle diameters of 250 μm (60 mesh) or less are mutually bonded to each other, said chromium, said molybdenum, and metal carbide being respectively diffused into particles of said other powders beyond the bonding surfaces thereof so that the local concentration of said chromium is variable between rich and poor.

5. The contact electrode material as set forth in claim 4, wherein said chromium carbide is selected from the group consisting of $Cr_3C_2$, $Cr_7C_6$, $Cr_{23}C_6$ and mixtures of at least two of $Cr_3C_2$, $Cr_7C_3$, and $Cr_{23}C_6$.

6. The contact electrode material as set forth in claim 4, wherein said molybdenum carbide is selected from the group consisting of $Mo_2C$, MoC and mixtures of $Mo_2C$ and MoC.

7. The contact electrode material as set forth in claim 4, wherein particle diameters of said chromium powder, said molybdenum powder and said metal carbide powder are 149 μm (100 mesh) or less.

* * * * *